US007536940B2

(12) United States Patent
Nakayama et al.

(10) Patent No.: US 7,536,940 B2
(45) Date of Patent: May 26, 2009

(54) CLEAN BOOTH AND SHEET CONVEYOR DEVICE

(75) Inventors: Takehiko Nakayama, Sizuoka (JP); Hiroyuki Nishida, Shizuoka (JP); Hideyuki Uezono, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 376 days.

(21) Appl. No.: 10/321,808

(22) Filed: Dec. 18, 2002

(65) Prior Publication Data

US 2003/0128977 A1 Jul. 10, 2003

(30) Foreign Application Priority Data

Dec. 20, 2001 (JP) ..... 2001-388214
Jan. 25, 2002 (JP) ..... 2002-017459

(51) Int. Cl.
*B26D 7/06* (2006.01)
*B65G 45/22* (2006.01)

(52) U.S. Cl. ..... 83/401; 83/435.2; 198/494; 198/495

(58) Field of Classification Search ..... 83/155.1, 83/948, 100, 401, 435.2; 198/957, 831, 847, 198/840, 852; 271/198; 414/940; 396/612, 396/613
See application file for complete search history.

(56) References Cited

U.S. PATENT DOCUMENTS 4,048,669 A * 9/1977 Bowler et al. ..... 361/726
4,821,866 A * 4/1989 Melgaard ..... 198/494
4,877,123 A * 10/1989 Fukuwatari et al. ..... 198/619
5,002,178 A * 3/1991 Yamada ..... 198/847
5,240,531 A * 8/1993 Toda et al. ..... 156/137
5,316,132 A * 5/1994 Muraoka et al. ..... 198/847
5,895,138 A 4/1999 Oku et al.
6,009,290 A * 12/1999 Mochida ..... 399/162
6,021,790 A * 2/2000 Yoshitani et al. ..... 134/62
6,226,486 B1 * 5/2001 Itou et al. ..... 399/303
6,405,430 B1 * 6/2002 Weyerman ..... 29/827
6,709,728 B2 * 3/2004 Kerr et al. ..... 428/47
6,803,529 B2 * 10/2004 Takahashi ..... 177/119

FOREIGN PATENT DOCUMENTS

JP 5-18576 1/1993
JP 10-39485 2/1998

* cited by examiner

*Primary Examiner*—Boyer Ashley
*Assistant Examiner*—Omar Flores Sánchez
(74) *Attorney, Agent, or Firm*—Sughrue Mion, PLLC

(57) ABSTRACT

A clean booth has a conveyor area for carrying recording sheets, and a motor drive area for containing motor and mechanical parts that emit much dust. The conveyor area and the motor drive area are covered respectively, and separated by a frame plate. Moreover, fan filter units blow pressurized clean air into the conveyor area to discharge dust while a ventilation system exhausts air in the motor drive area. There is no airflow from motor drive area to the conveyor area because of the difference in air pressure. The recording sheets in the conveyor area are carried by belt conveyors with artificial suede belts. The artificial suede belt is suitable to be used as a conveyer belt because of low dust emission and sufficient flexibility to prevent flaw or pressure marks on the recording sheets.

15 Claims, 9 Drawing Sheets

CLEAN BOOTH AND SHEET CONVEYOR DEVICE

BACKGROUND OF THE INVENTION

1. Field of the Invention

The present invention relates to a clean booth and a sheet conveyor device which are suitable for feeding recording sheets, and more particularly to a clean booth and a sheet conveyor device that are able to decrease the amount of dust near the recording sheets.

2. Description Related to the Prior Art

In manufacturing sheet products, such as photosensitive recording sheet products, a recording sheet web is pulled out of a recording sheet roll, and is cut to form plural recording sheets of a certain length. The recording sheets are conveyed to a collection unit in which several recording sheets are bunched. Then, a bunch of the recording sheets is covered with a protection cover and a light-shielding film.

In the above manufacturing process, conveyor belts come in contact with the recording sheets during conveyance, so the recording surface of the recording sheet is damaged by poor quality conveyor belt. Thus, the conveyor belt is required to be made of a material with low dust emission to protect the recording sheet from dust, and with sufficient flexibility to prevent pressure marks or flaw on the recording surface of the recording sheet.

As for the material for the conveyor belt, JP-A 10-39485 discloses a conveyor belt in which flexible fiber is transplanted so as to increase flexibility on the conveyance side. Because of much emission of dust, however, transplanted fiber is not suitable for conveyance of photosensitive recording sheets. In order to accomplish low dust emission, U.S. Pat. No. 5,895,138 (corresponding to JP-A 9-325465) describes a conveyor belt covered with a material such as urethane. The conveyor belt of urethane, however, does not have sufficient flexibility to prevent pressure marks or flaw on the recording sheet.

In the sheet product manufacturing line, there are dust sources other than the conveyor belt. For instance, a motor drive mechanism is provided to operate a sheet cutter, a sheet conveyor, a sheet collector and so forth. The motor drive mechanism is composed of mechanical parts such as transmission belts, pulleys and gears. These mechanical parts rubbed with each other to generate dust, which causes deterioration in the quality of the recording sheets.

In order to remove dust in the manufacturing line, JP-A 5-18576 describes a clean room in which high-pressurized clean air blows downward through fan filter units in the ceiling. Clean air is blown outside together with dust through plural holes in the floor. However, the motor drive mechanism and the conveyor mechanism are provided in the same clean room. High-pressure clean air from the ceiling blows and flies dust onto the mechanical parts and the conveyor belt at the same time. Thus, the recording sheet is easily damaged by dust generated from the mechanical parts of the motor drive mechanism.

SUMMARY OF THE INVENTION

An object of the present invention is to provide a sheet conveyor device with low dust emission that prevents flaw and pressure marks on recording sheets.

Another object of the present invention is to provide a clean booth to protect the recording sheets from dust generated by a motor drive mechanism.

To achieve the above objects, the clean booth of the present invention comprises of a conveyor area for containing a conveyor belt for carrying a sheet material, and a drive area to contain a drive mechanism to drive the conveyor belt. The conveyor area and the drive area are respectively covered with a conveyor housing and a drive area housing. The conveyor area is separated from the drive area.

A photosensitive recording sheet is used as a sheet material, and the conveyor area is kept in light-tight manner. A cutter device is located in the conveyor area to cut the sheet material into cut sheets. In order to discharge dust emitted from the cutter device and the cut sheets, an exhauster is disposed in the conveyor area.

For the purpose of protecting the conveyor area from dust in the drive area, air pressure in the conveyor area is higher than that in the drive area and external pressure. Moreover, air pressure in the drive area is lower than external pressure.

A transmission shaft is located in the conveyor area to transmit drive power from the drive mechanism. In order to shield the conveyor area from dust generated by rotational friction between the transmission shaft and the drive mechanism, labyrinth seals are fixed to the transmission shaft.

The conveyor belt has an artificial suede layer with low dust emission. The conveyor belt is fastened to conveyor rollers having a diameter of 35 mm-300 mm. The conveyor roller has a circular protruded portion in the center area of the outer surface to support the conveyor belt. An elastic displacement of the conveyor belt is from 0.3 mm to 0.9 mm when the conveyor belt is pressed to have resilience of 250 g/cm$^2$.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
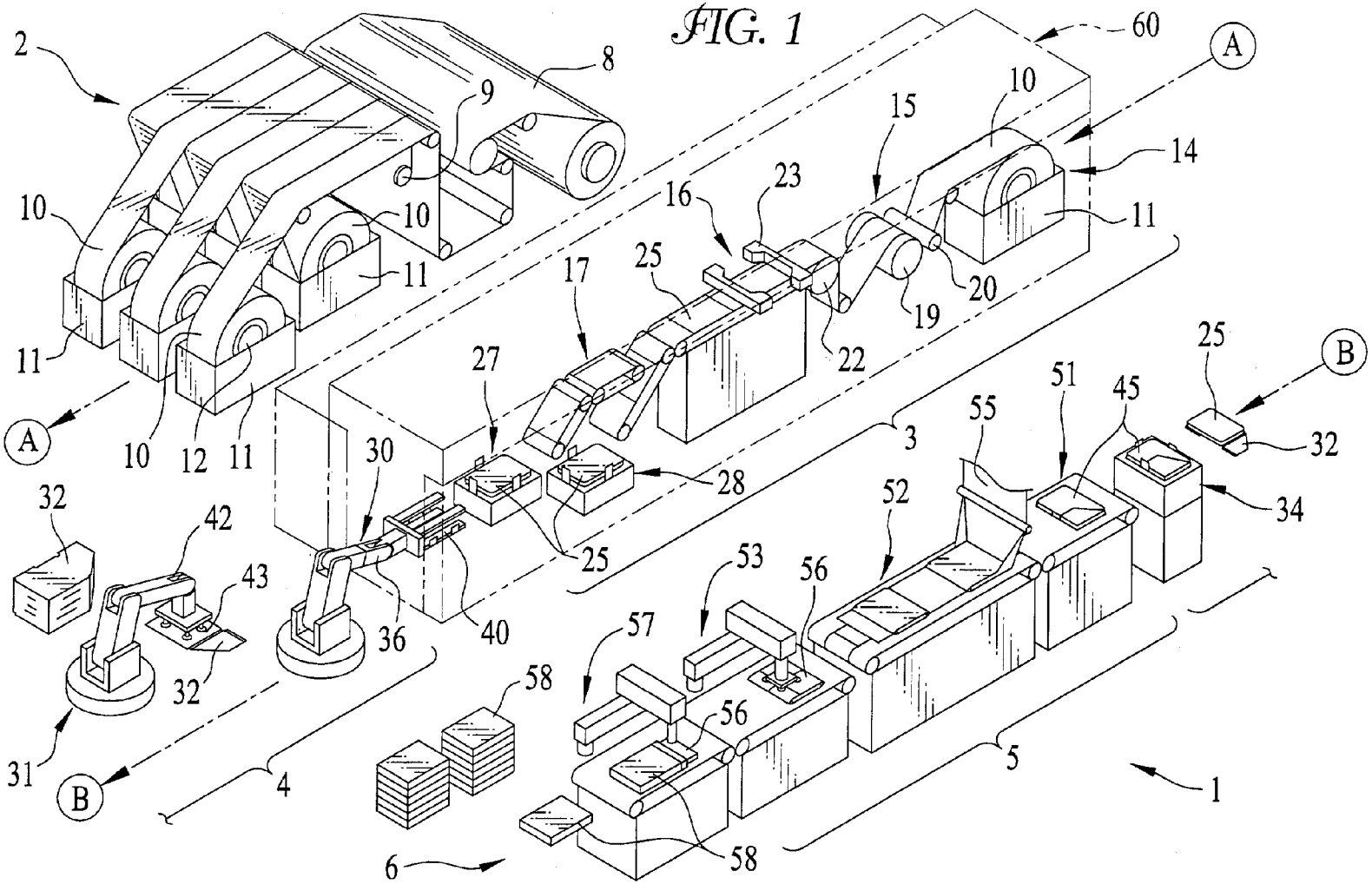
FIG. 1 is a perspective view of an X-ray recording film production system.

FIG. 1 shows an embodiment in which an X-ray recording film strip is processed to produce X-ray recording sheet package. In an X-ray recording film production system 1, a web slicer 2, a web cutter 3, a sheet covering machine 4, a wrapping machine 5 and a packing machine 6 are arranged in this order. The process speeds of all machines 2-6 are balanced with one another so as to produce the recording sheet packages at a predetermined rate.

The recording sheet production system 1 is contained in a clean room. The web slicer 2, the web cutter 3, the sheet covering machine 4 and the wrapping machine 5 are separated in a darkroom or a clean booth with light-tight function.

The slicer 2 feeds a recording film web 8 of a long width, and cut the web 8 into a sliced web 10 by use of a cutter blade 9. The sliced web 10 is wound around a core 12 that is loaded in a web container 11. After winding a certain length of the sliced web 10, the web container 11 is carried to the web cutter 3 from the web slicer 2.

The web cutter 3 carries out processes to cut the sliced web 10 into recording sheets of a certain length, and to bunch several recording sheets. The web cutter 3 has a web feeding unit 14, a de-curling unit 15, a cutter unit 16 and a collection unit 17. Each of these units 14-17 is supported by racks of the same size in accordance with the size of the sliced web 10, and the rack is easily attached or removed by screwing or unscrewing bolts.

The sliced web 10 is drawn out of the web container 11 in the web feeding unit 14 with certain tension. The web feeding unit 14 has a function to join a trailing end of a used sliced web with a leading end of a new sliced web.

The de-curling unit 15 has a heating roller 19 and a cooler. A dancer roller 20 is disposed in an upstream position of the heating roller 19 to decrease fluctuation in the tension of the sliced web 10. The heating roller 19 heats the sliced web 10 at a temperature not to affect the recording layer. During the heating, the heating roller 19 pulls the sliced web 10 in the direction opposite to the rolled direction, by which the curl of the sliced web 10 is corrected. After the curl correction, the sliced web 10 is cooled down.

The cutter unit 16 has a suction drum 22, a cutter device 23. The suction drum 22 continuously feeds the sliced web 10 in a feeding direction shown by the arrow. The cutter device 23 is mechanically or electrically activated in synchronous to the suction drum 22, and cuts the sliced web 10 into a recording sheet 25 of a certain length.

Figure 2:
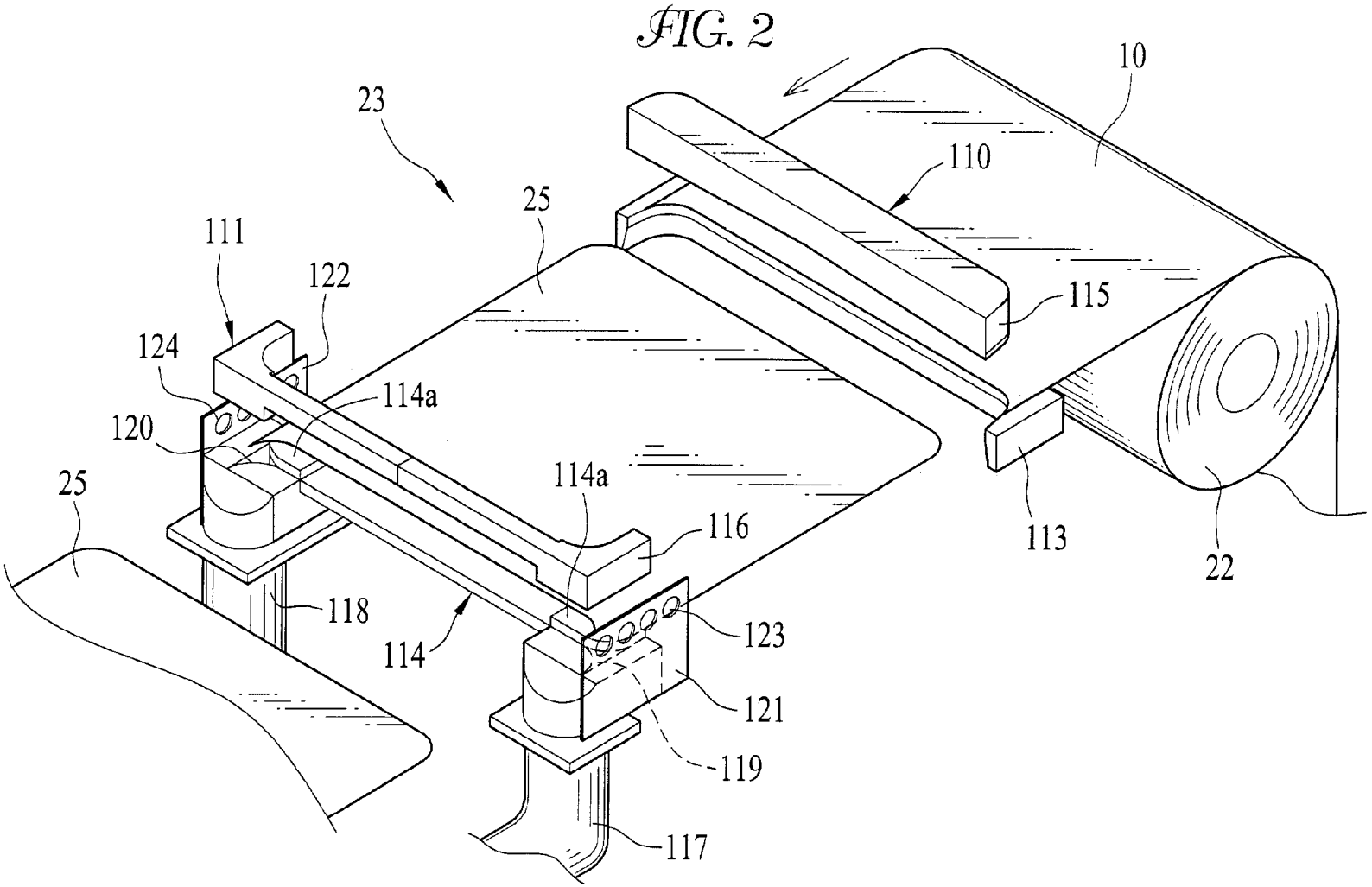
FIG. 2 is a perspective view of a cutter unit to cut a web into recording sheets.

As shown in FIG. 2, the cutter device 23 has a first cutter 110 and a second cutter 111 of rotary oscillate type. The first cutter 110 consists of a lower blade 113 and an upper blade 115. The lower and the upper blades 113, 115 have edges that extend in a lateral direction perpendicular to the feeding direction of the sliced web 10. The lateral end portions of the blades 113, 115 are curved so as to trim the corners of the recording sheets 25 to form arcs. While the upper blade 115 rotates in the clockwise direction around the axis parallel to the lateral direction, the lower blade 113 moves in the feeding direction. During their movements, the lower and the upper blades 113, 115 contact with each other to cut the sliced web 10.

The second cutter 111 consists of a lower blade 114 and an upper blade 116. The lower blade 114 has curved edges in the lateral end portions to trim the corners of the recording sheet 25. The upper blade 116 also has curved edges to fit the edges of the lower blade 114.

The first and second cutters 110, 111 are rotary oscillate cutters, so it is possible to cut the sliced web 10 into the recording sheets 25 during the conveyance of the sliced web 10. It is also possible to fix the lower blade, and to move the upper blade vertically toward the lower blade to cut the sliced web. In that case, the suction drum 22 temporarily stops conveyance of the sliced web 10 for cutting into recording sheets.

An exhauster, provided near the second cutter 111, has a pair of absorption pipes 117, 118, and a pump (not shown) connected to the absorption pipes 117, 118. A pair of nozzles with vents 119, 120 of triangular shape is attached to the absorption pipes 117, 118. When the second cutter 111 cuts the recording sheet 25, the recording sheet 25 generates a pair of triangular chips in the corners. The chips are absorbed by the exhauster through the vents 117, 118. A pair of plates 121, 122 is fixed to the nozzles to prevent scattering of the chips. In the operation of the exhauster pump, air is flown toward the vents 119, 120 through holes 122, 124 formed in the plates 121, 122. Thus, the chips of the recording sheet 25 are blown toward the absorption pipes 117, 118.

Figure 4:
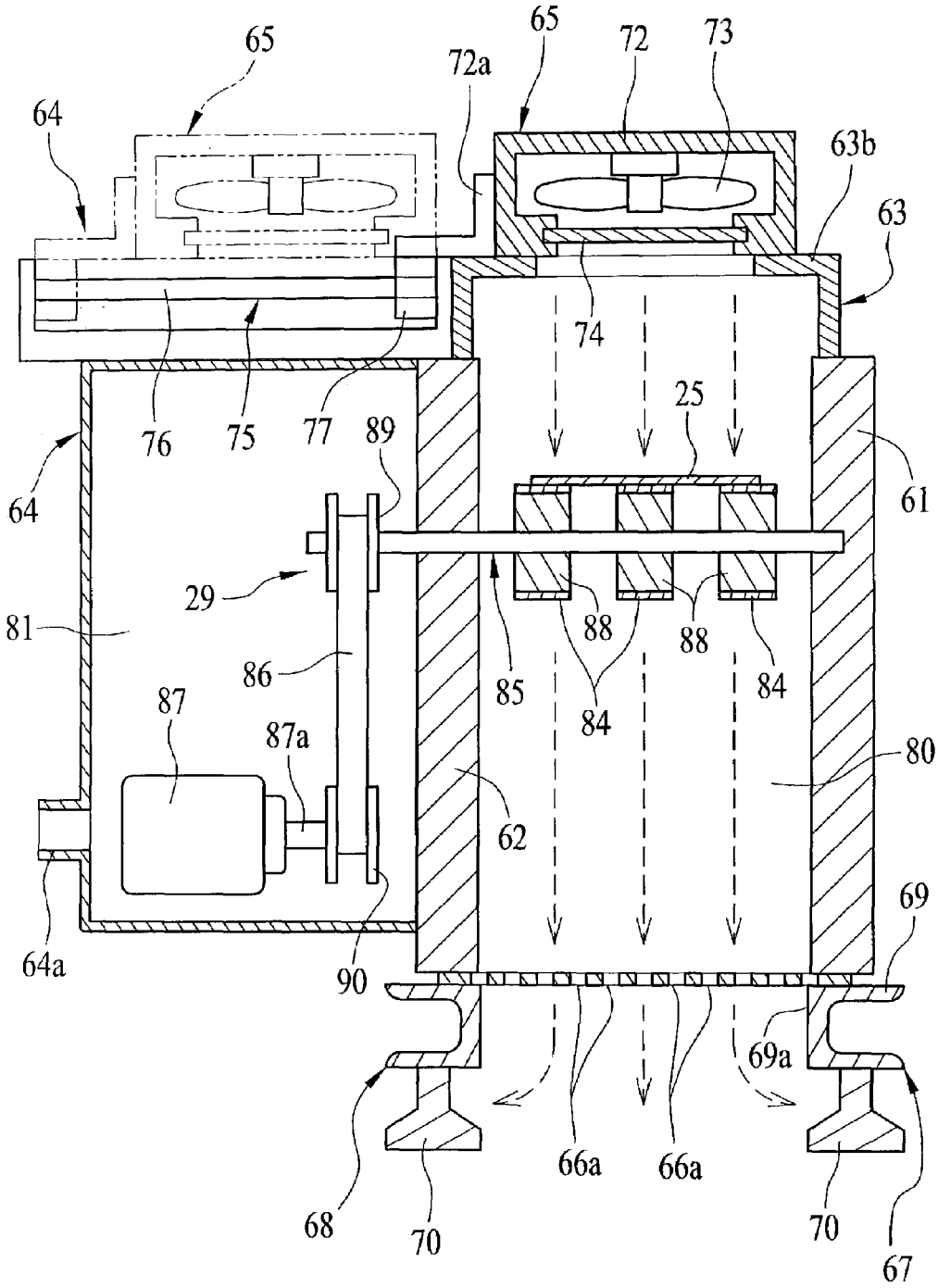
FIG. 4 is a schematic cross section of the clean booth of FIG. 3.

In FIG. 1, the collection unit 17 has collection frames 27, 28, a belt conveyor 29 (see FIG. 4). The belt conveyor 29 feeds the recording sheets 25 to the collection frames 27, 28 through a collection gate. Thereby, several recording sheets 25 are collected on the collection frames 27, 28 to obtain a bunch of the recording sheets 25. The collection unit 17 also has an ejection gate to remove irregular recording sheets out of the web cutter 3.

The wrapping machine 4 has a sheet handling unit 30 to hold a bunch of the recording sheets 25, a cover handling unit 31 to hold a protection cover 32, and a folding unit 34 to fold the protection cover 32 around the bunch of the recording sheets 25.

The sheet handling unit 30 is an all-purpose industrial robot with an arm portion 36. A hand 40 is attached to the arm portion 36 to hold and carry a bunch of the recording sheets 25. The arm portion 36 inserts the hand 40 into the web cutter 3, and moves the hand 40 towards one of the collection frames 27, 28. Then, the arm portion 36 bends at its joints to hold the bunch of the recording sheets 25, pick it up and carries it to the outside of the web cutter 3.

The cover handling unit 31 is an all-purpose industrial robot with an arm portion 42. An air absorption pad 43 is assembled to the arm portion 42 to adhere to the uppermost protection cover 32 from a bunch of the protection covers 32. The protection cover 32 is a thick and strong paper like a cardboard. The protection cover 32 is carried by the cover handling unit 31 onto the bunch of the recording sheets 25. Then, the arm portion 36 of the sheet handling unit 30 rotates the hand 40 and puts the bunch of the recording sheets 25 on the folding unit 34. The folding unit 34 folds the protection cover 32 around the front and the rear sides of the bunch of the recording sheets 25, so that a covered sheet bunch 45 is made.

The covered sheet bunch 45 is fed to the wrapping machine 5 that has a conveyor unit 51, a film wrapping unit 52 and a film folding unit 53. The conveyor unit 51 is a belt conveyor which carries the covered sheet bunch 45 toward the film wrapping unit 52.

The film wrapping unit 52 wraps a light-shielding film 55 around the covered sheet bunch 45. Both lateral ends of the light-shielding films 55 are heated and sealed in the light-tight manner. Then, after removing air inside the light-shielding films 55, the front portion and the rear portion of the light-shielding films 55 are heated and tightly sealed in light-tight manner by use of a cross sealer. After sealing, the film wrapping unit 52 cuts a front and a rear portions of the light-shielding films 55 to form a sheet package 56 that has a pair of flaps in the front and the rear portions.

The sheet package 56 is conveyed to the film folding unit 53. The film folding unit 53 has an industrial robot with an arm to hold the flaps in the front and rear portions. Pulling the flaps in the opposite directions to apply tension to the sheet package 56 to prevent wrinkles, the flaps are folded on the sheet package 56. The folded flaps are held by a label adhered to the sheet package 56.

The packing machine 6 has a packing unit 57 and an inspection unit. The packing unit 57 puts the sheet package 56 into a wrapping box 58. After the labeling process and lot number printing process, the wrapping box is forwarded to the inspection unit to check the label and lot number by use of image processing device. After inspection, the wrapping boxes 58 are contained in a cardboard box for shipment.

Figure 3:
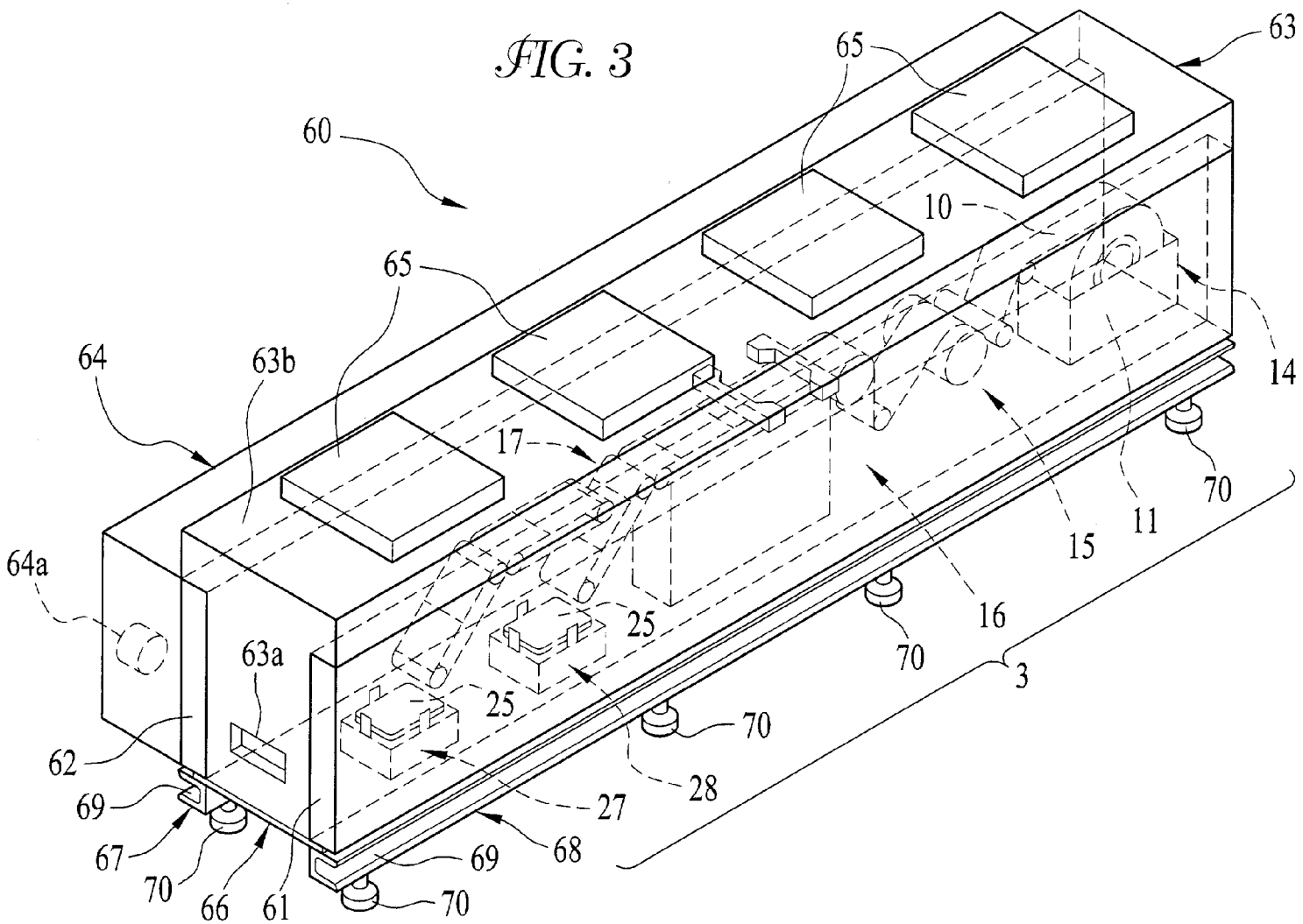
FIG. 3 is a perspective view of a clean booth for a web cutter of the film production system.

In FIGS. 3 and 4, the web cutter 3 is contained in a clean booth 60. The clean booth 60 includes a pair of frame plates 61, 62, conveyor area housing 63, a drive area housing 64, a fan filter unit 65, a punched metal plate 66 and a pair of base members 67, 68. Each of the base members 67, 68 consists of a C-shaped steel 69 and several support legs 70 attached to the C-shaped steel 69. The C-shaped steels 69 have rear surfaces 69*a* that faced each other. The punched metal plate 66 located on the C-shaped steels 69 has a plurality of vents 66*a*. The heights of the support legs 70 are adjustable so that the metal plate 66 is not inclined.

The frame plates 61, 62 are assembled on both lateral sides of the punched metal plate 66 above the C-shaped steel 69. The conveyor area housing 63 is firmly screwed to the frame plates 61, 62 to cover a conveyor area 80 (see FIG. 4) together with the frame plates 61, 62 and the punched metal plate 66, so that the conveyor area 80 is kept in light-tight manner for conveying photosensitive recording materials. The frame plates 61, 62 cover both lateral sides of the conveyor area 80. The conveyor area housing 63 covers the upstream, downstream and top sides of the conveyor area 80. The punched metal plate 66 covers the bottom side of the conveyor area 80. In the conveyor area 80, the web feeding unit 14, the de-curling unit 15, the cutter unit 16 and the collection unit 17 are located to feed the sliced web 10.

The conveyor housing 63 has an opening 63*a* in the downstream side for ejecting a bunch of the recording sheets 25 on the collection frame 27, 28. The hand 40 of the sheet handling unit 30 goes into the conveyor area 80 through the opening 63*a* and carries a bunch of the recording sheets 25 out of the web cutter 3.

The drive area housing 64 is fixed to the frame plate 62 opposite to the conveyor area housing 63. The drive area housing 64 and the frame plate 62 tightly cover a motor drive area 81, in which a motor drive mechanism for the units 14-17 of the web cutter 3 is contained.

Four fan filter units 65 are provided on the upper side 63*b* of the conveyor area housing 63 at certain intervals. The fan filter unit 65 has a fan housing 72 that holds a fan 73 and a filter 74 to remove dust. The fan 73 absorbs air through an inlet (not shown) formed in the upper surface of the fan housing 72, and blows pressurized air downward to the filter 74. Pressurized air from the fan 73 becomes clean through the filter 74, and blown to the conveyor area 80 as shown by dotted arrows in FIG. 4. Cleaned air is blown to the units 14-17 and the recording sheet 25 and discharged outside the conveyor area housing 63 together with dust in the conveyor area 80 through the vents 66*a*.

A fan guide unit 75 is located above the drive area housing 64. The fan guide unit 75 guides the fan filter unit 65 between a first position (shown by solid lines in FIG. 4) above the conveyor area housing 63, and a second position (shown by two-dotted lines) above the drive area housing 64. The fan guide unit 75 has a guide rail 76 and a bearing 77. The guide rail 76 on the top side of the drive area housing 64 extends in a direction perpendicular to the feeding direction of the recording sheet 25. The bearing 77 is fixed to an attachment member 72*a* on the lateral side of the fan housing 72.

In operation of the clean booth 60, the fan filter unit 65 is at the first position to blow clean air to the conveyor area 80. In maintenance of the clean booth 60, an operator moves the fan filter unit 65 to the second position from the first position. Then, the conveyor area 80 is exposed through holes in the top side of the conveyor area housing 63, so the operator can clean or repair the units 14-17 easily.

In FIG. 4, a belt conveyor 29 of the collection unit 17 is depicted. The belt conveyor 29 includes conveyor belts 84, a transmission shaft 85 and a transmission belt 86, which are activated by a motor 87. The belt conveyor 29 is also provided with the web feeding unit 14, the de-curler unit 15 and the cutter unit 16. The units 14-17 of the web cutter 3 have drive shafts of the same size that are mechanically connected to one another by use of flexible couplings, so that the operation of the units 14-17 are synchronized with one another. Instead of transmitting drive power by use of flexible couplings, each of the units 14-17 may be provided with an individual motor. In that case, these motors are synchronized with one another so as to feed the recording sheets 25 at a certain speed.

Figure 5:
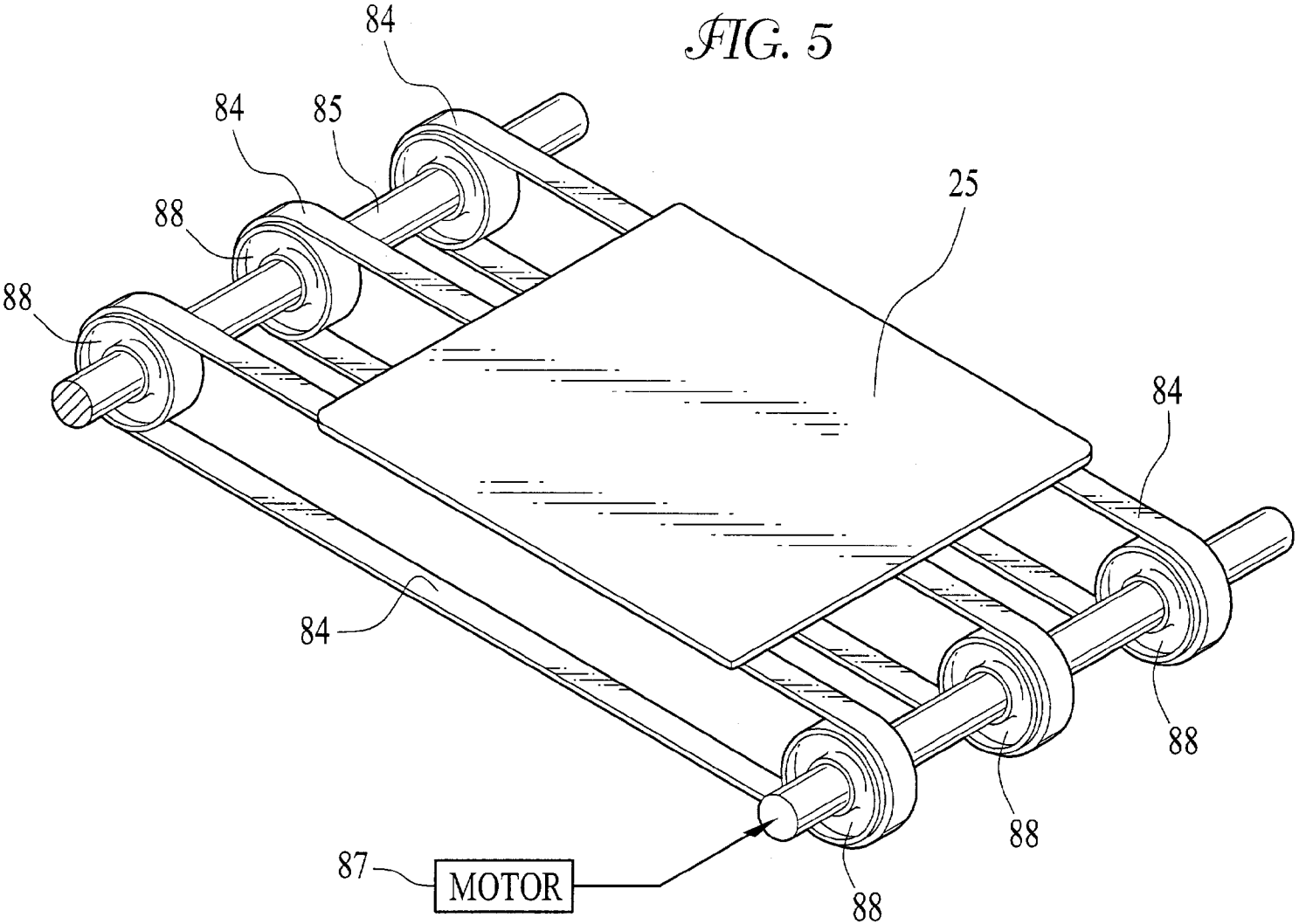
FIG. 5 is a perspective view of a conveyor to feed the recording sheet.

The transmission shaft 85 is rotatably attached to the frame plate 61. One end of the transmission shaft 85 goes through the frame plate 62, and projects inside the motor drive area 81. Conveyor rollers 88 are fixed to the transmission shaft 85, and rotate together with the transmission shaft 85. A pulley 89 in the motor drive area 81 is fixed to one end of the transmission shaft 85. Conveyor belts 84 are fastened between the conveyor rollers 88. A pulley 90 is rotatably fixed to a rotation shaft 87*a* of the motor 87. A transmission belt 86 is fastened between the pulleys 89, 90. The drive power of the motor 87 is transmitted to the conveyor rollers 88 through the transmission belt 86 and the transmission shaft 85, so that the conveyor belt 84 rotates to carry the recording sheets 25, as shown in FIG. 5.

In operation, the motor 87, the transmission belt 85 and the pulleys 89, 90 are rubbed with each other to generate much dust in the motor drive area 81. Moreover, the motor 87 vibrates in operation and causes dust to fly in the motor drive area 81. The conveyor area 80, however, is completely separated from the motor drive area 81 by the frame plate 62 and the drive area housing 64, so the recording sheet 25 in the conveyor area 80 is not affected by dust in the motor drive area 81.

In order to remove dust generated in the motor drive area 81, a vent 64*a* is formed in the lateral side of the drive area housing 64. An exhauster (not shown), similar to the fan filter unit 65, is connected to the drive area housing 64, and discharges dust in the motor drive area 81 outside through the vent 64*a*.

In each of the units 14-17 that constitute the web cutter 3, the recording sheet 25 or the sliced web 10 is conveyed in the conveyor area 80. On the other hand, the motor, the transmission belt and pulleys are disposed in the motor drive area 81 to protect the conveyor area 80 from dust.

Figure 6:
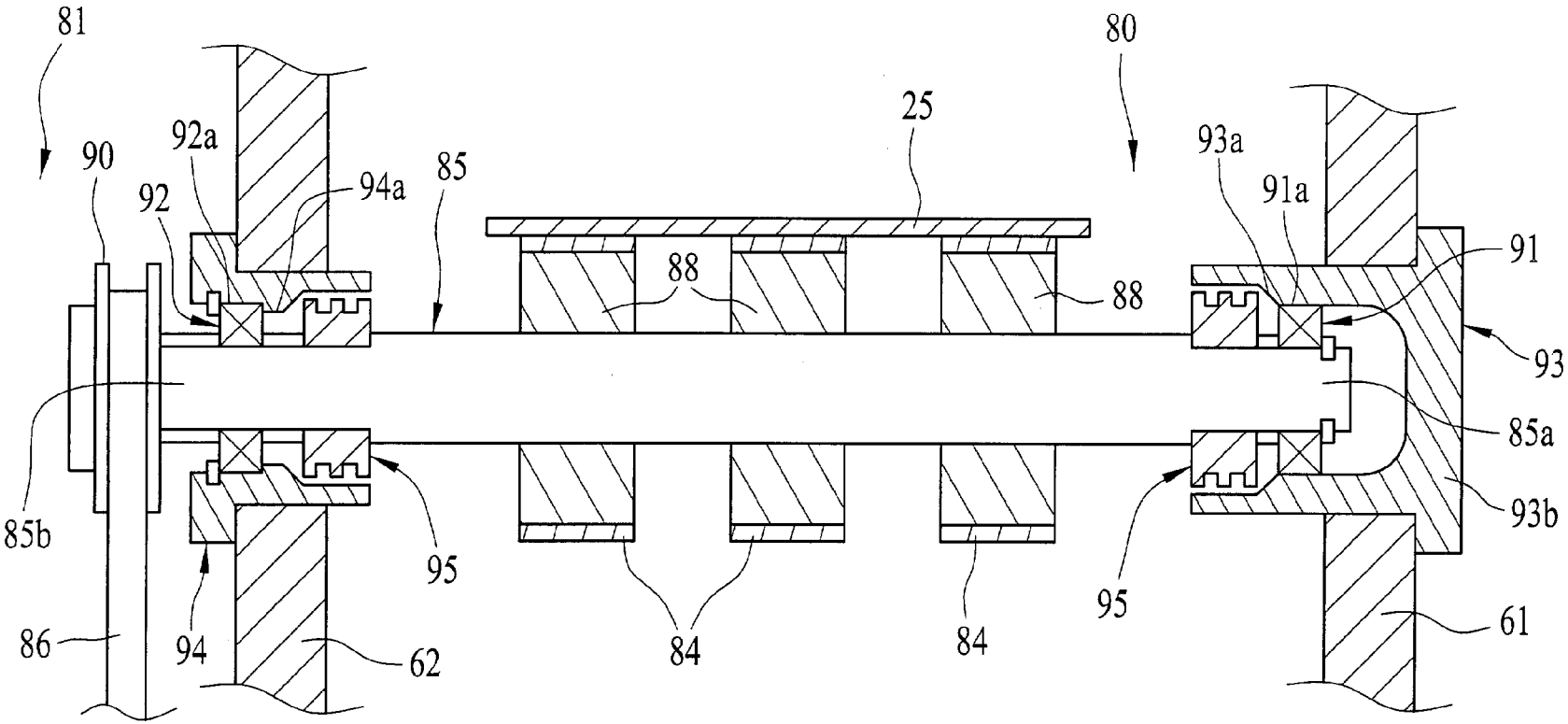
FIG. 6 is a partial cross section of the conveyor.

In FIG. 6, the transmission shaft 85 has end portions 85*a*, 85*b* that are rotatably supported by a pair of conventional ball bearings 91, 92. The outer surfaces 91*a*, 92*a* of the bearings 91, 92 are engaged with inner surfaces 93*a*, 94*a* of cylindrical support members 93, 94. The support members 93, 94 fit into holes formed in the frame plate 61, 62, and fixed to the frame plate 61, 62, respectively. The support member 93 has a basement 93*b* to cover the hole in the frame plate 61.

A pair of labyrinth seals 95 is fixed to both end portions 85*a*, 85*b* of the transmission shaft 85. The labyrinth seal 95 has a higher coefficient of friction than a rubber seal, and is less expensive than a magnetic fluid seal. The labyrinth seals 95 are located between the bearings 91, 92. The labyrinth seals 95 seal the inner surfaces 93*a*, 94*a* of the support members 93, 94 to protect the conveyor area 80 from dust, grease and oil on the bearings 91, 92.

Figure 7:
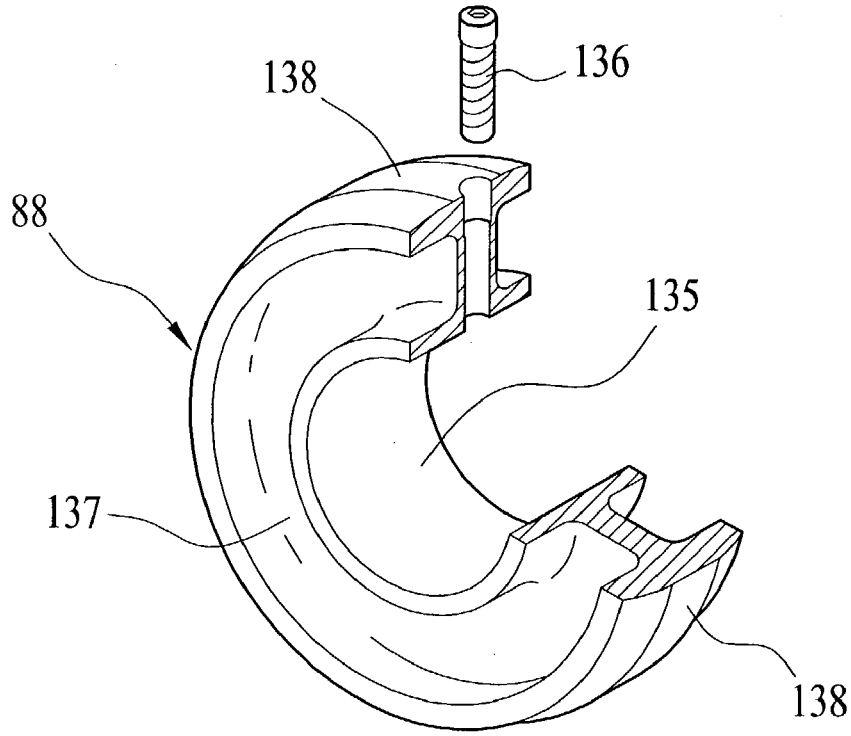
FIG. 7 is a perspective view with a partial cross section of a pulley of the conveyor.

As shown in FIG. 7, the conveyor roller 88 has a cylindrical shape with an H-shaped cross section. The transmission shaft 85 is inserted into a socket 135 formed in the center of the conveyor roller 88. The conveyor roller 88 is fixed to the transmission shaft 85 by a screw 136. A pair of hollows 137 is formed in both sides of the conveyor roller 88, so that the conveyor roller 88 becomes lighter. The conveyor roller 88 has a circular protruded portion 138 in the center area of the outer surface. The conveyor belt 84 is supported by the protruded portion 138, so it is not necessary to provide a pair of guide rail on both edge of the conveyor roller 88. Since there is no guide rail that causes friction in the edge portion of the conveyor belt 84, the amount of dust from the conveyor belt 84 is decreased.

Moreover, the conveyor roller 88 having a diameter of more than 35 mm makes a gentle curvature of the conveyor belt 84 to decrease friction force between the conveyor roller 88 and the conveyor belt 84. Thus, it is possible to decrease the amount of dust from the conveyor belt 84. In the preferred embodiment, the conveyor roller 88 with a diameter of 300 mm is used.

Figure 8:
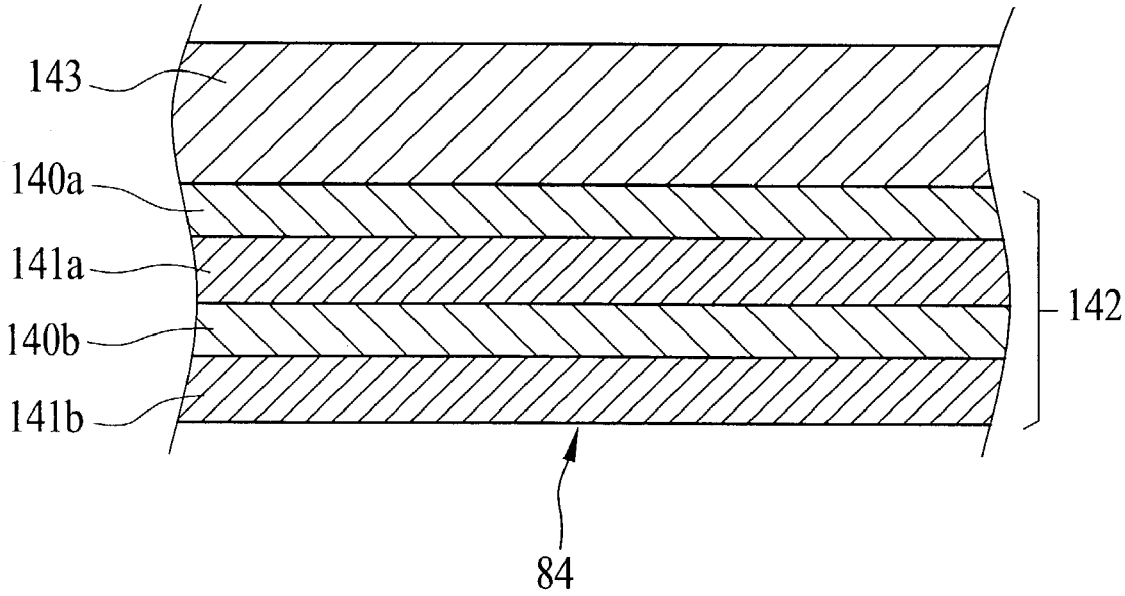
FIG. 8 is a sectional view of a conveyor belt.

In FIG. 8, the conveyor belt 84 consists of a belt base 142 and an artificial suede layer 143. The belt base 142 has two polyurethane layers 140*a*, 140*b* and two polyester layers 141*a*, 141*b*. The polyurethane layers 140*a*, 140*b* and the polyester layers 141*a*, 141*b* are alternately stacked. Besides polyurethane or polyester, polyvinyl chloride, polyamide, urethane, artificial rubber may be used as materials of the belt base 142. The artificial suede 143 is made by weaving extra fine artificial fibers. The artificial suede layer 143 is welded to the belt base 142 by heating the polyurethane layer 140*a* so as to prevent unevenness in thickness of the conveyor belt 84. As for material of the artificial suede layer 143, BELLESEIME (trademark) manufactured by Kanebo Gohsen, LTD. or ECSAINE (trademark) manufactured by Toray Co., LTD. is preferably used.

Figure 9:
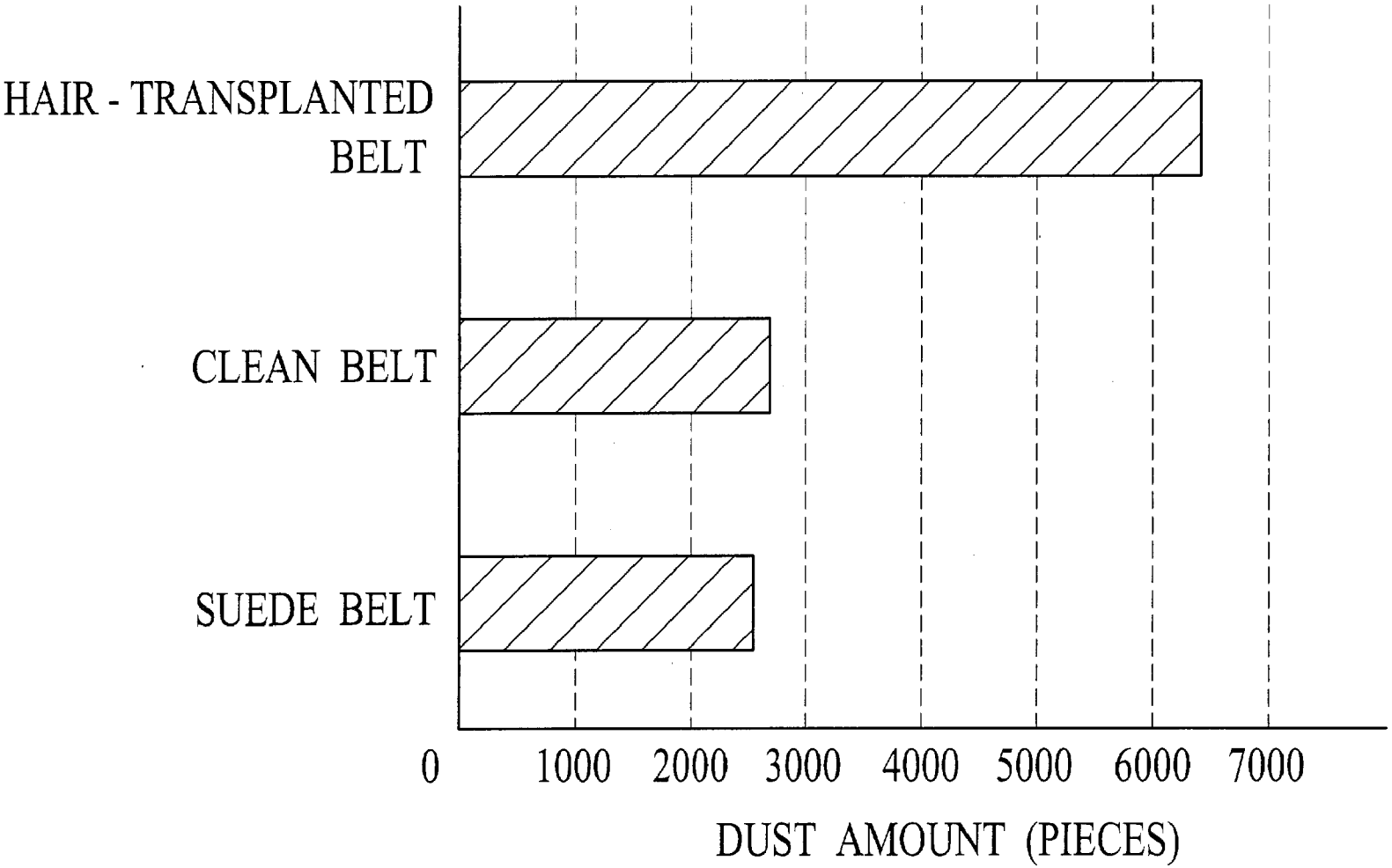
FIG. 9 is a graph showing amount of dust that is generated from the conveyor belts of different materials.

FIG. 9 shows a result of an experiment to measure amounts of dust from the conveyor belt 84 of different materials. After rotating the conveyor belt 84 for a predetermined time, the number of generated dust of more than 0.5 μm is counted. The diameter of the conveyor roller 88 is 80 mm. As for materials of the conveyor belt 84, a hair-transplanted belt, a clean belt used in a clean room, and artificial suede belt are used. In this experiment, NITTA PE100-2 (trade name), manufactured by Nitta Corp., is used as the clean belt.

The result of this embodiment shows that the dust amount of the artificial suede belt is much lower than that of the hair-transplanted belt, and is almost the same as that of the clean belt. In addition, the dust amount of the suede belt becomes much lower than other belts as the diameter of the conveyor roller 88 becomes larger.

Figure 10:
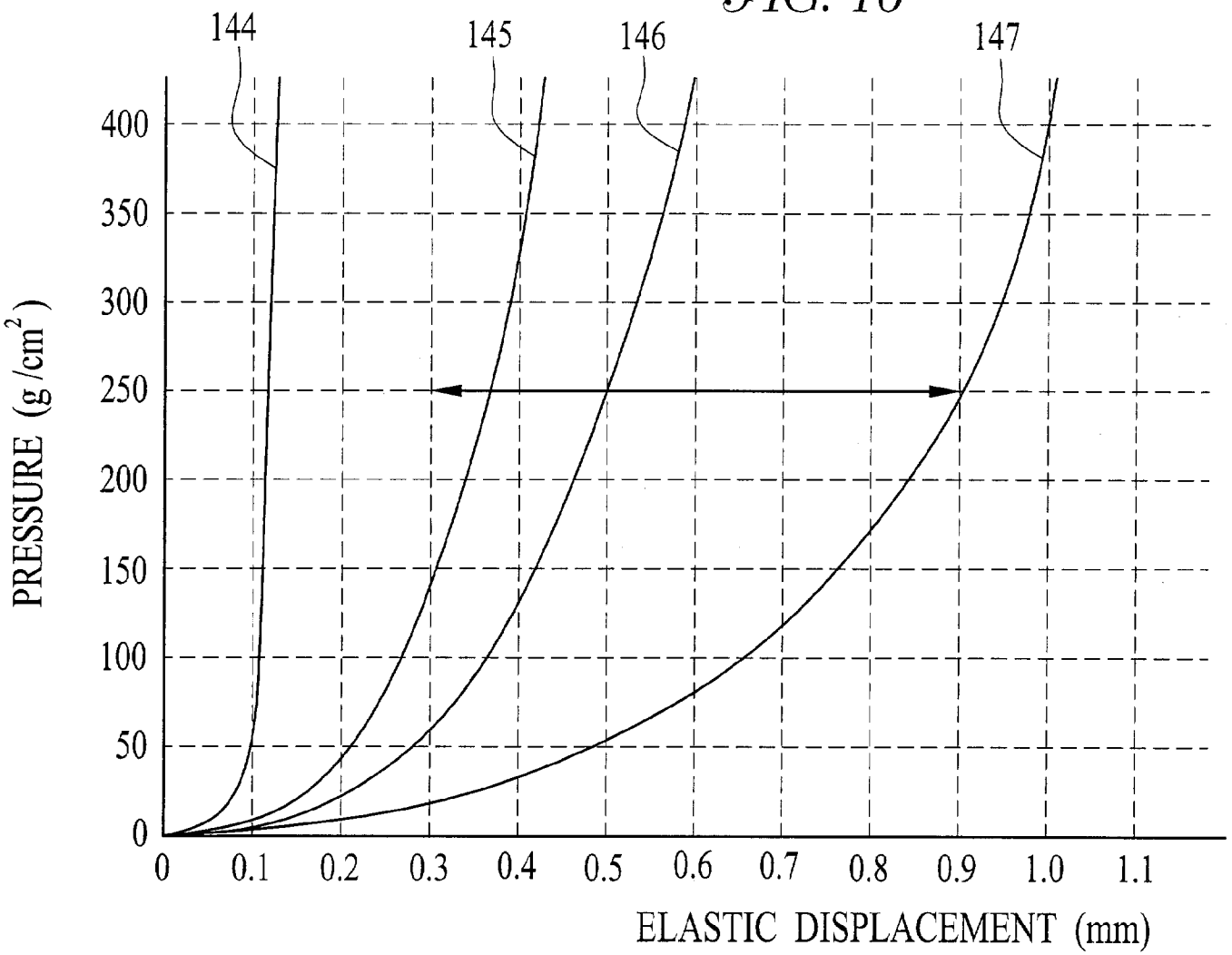
FIG. 10 is a graph showing pressure of the conveyor belts of different materials.

FIG. 10 shows a result of an experiment to measure the flexibility of the hair-transplanted belt, the clean belt and the artificial suede belt. The horizontal axis shows an elastic displacement (mm) of the surface when the conveyor belt is pressed by use of a metal cylinder. The vertical axis shows pressure of resilience (g/cm$^2$) against the metal cylinder. Under the condition of the same displacement, larger resilience pressure means less flexibility that causes flaw or pressure marks on the recording sheet 25.

The characteristic curves of the clean belt 144, the artificial suede belt of BELLESEIME (trademark) 145, the artificial suede belt of ECSAINE (trademark) 146, and the hair-transplanted belt 147 are shown in FIG. 10. These curves show that the clean belt has the largest resilience pressure among the materials, hence the clean belt has less flexibility and is not suitable for carrying the recording sheet. On the other hand, the hair-transplanted belt has the largest flexibility. It is proven that the flexibility of artificial suede belt is in between the hair-transplanted belt and the clean belt. For the purpose of carrying the recording sheet, it is preferable to use the artificial suede belt having elastic displacement from 0.3 mm to 0.9 mm under the resilience pressure of 250 g/cm$^2$ (shown by the arrow in FIG. 10).

The operation of the production system 1 of this embodiment is explained below. First, the cutter blade 9 slices the web 8 to form the sliced webs 10 with a predetermined width. The sliced web 10 is drawn into the web container 11, which is sent to the web cutter 3. In the web cutter 3, the sliced web 10 is pulled out of the web container 11, corrected its curl by the heating roller 19, and then cut to form recording sheets 25 with predetermined length. The recording sheets 25 are carried by the belt conveyor 29 toward the collection frames 27, 28. Since the surface of the conveyor belt 84 is artificial suede with low dust emission and high flexibility, it is possible to protect the recording sheet from dust, flaw or pressure mark.

The web cutter 3 is contained in the clean booth 60 that has the conveyor area 80 for carrying the recording sheets 25 and the motor drive area 81 for containing motor drive mechanism. The conveyor area 80 and the motor drive area 81 are separated by use of the frame plate 62 and housings 63, 64. Thus, the recording sheets 25 in the conveyor area 80 are protected from dust in the motor drive area 81. Moreover, the labyrinth seals 95 protect the conveyor area 80 from dust on the bearings 91, 92.

During operation of the web cutter 3, the conveyor belt 84, the cutter unit 16 and the edge of the recording sheet 25 generate dust in the conveyor area 80. The fan filter units 65 blow pressurized clean air into the conveyor area 80 to discharge dust outside the conveyor area 80. Moreover, the exhauster near the cutter device 23 absorbs the chips of the recording sheets 25 generated after cutting. Thus, it is possible to keep the conveyor area 80 clean during operation of the web cutter 3.

Because of a gap between the labyrinth seal 95 and the inner surface 94*a* of the support member 94, a narrow passage is formed between the conveyor area 80 and the motor drive area 81. However, pressurized air is blown into the conveyor area 80 while air is exhausted out of the motor drive area 81, so the air pressure in the conveyor area 80 is higher than that in the motor drive area 81. Due to the pressure difference, dust and oil on the bearings 92 are blown to the motor drive area 81. Moreover, by keeping the air pressure in the conveyor area 80 higher than external pressure, there is no airflow into the conveyor area 80 from the outside. Furthermore, if air pressure in the motor drive area 81 is kept lower than external pressure, it is possible to prevent airflow to the outside of the clean booth 60 from the motor drive area 81.

In this way, the recording sheet 25 in the conveyor area 80 is protected from dust, and is conveyed toward the collection plate 27, 28. A bunch of the recording sheets 25 on the collection plate 27, 28 are covered by the protection cover 32 and the light-shielding film 55. Then, the recording sheets 25 are labeled and put in the box for shipment.

Although the transmission belt 86, the transmission shaft 85 and the pulleys 89, 90 are in the motor drive area 81, it is possible to put these parts in the conveyor area 80. In that case, each mechanical part is separately covered by a container to prevent dust emission in the conveyor area 80.

The web slicer 2, the sheet covering machine 4, the wrapping machine and the packing machine 6 may be contained in the clean booth described in the above embodiment. It is also possible to use the clean booth to a device that has a sheet conveyor unit and a motor drive unit. The conveyor and the clean booth are also applicable to carry photo filmstrips, thermal sensitive films, and other kinds of recording sheets.

The present invention is not to be limited to the above embodiment but, on the contrary, various modifications will be possible to those skilled in the art without departing from the scope of claims appended hereto.

What is claimed is:

1. A sheet conveyor device for conveying a recording sheet material, comprising:

a conveyor belt for supporting said recording sheet material, said conveyor belt having a belt base and an artificial suede layer on said belt base;

a plurality of conveyor rollers to fasten said conveyor belt; and a drive mechanism for rotating said conveyor rollers, wherein said conveyor belt and said conveyor rollers are located in a conveyor area, and said drive mechanism is located in a drive area that is separated from said conveyor area, and wherein an air pressure in a clean booth is controlled so that a first air pressure in said conveyor area is higher than a second air pressure in said drive area.

2. A sheet conveyor device of claim 1, wherein an elastic displacement of said conveyor belt is from 0.3 mm to 0.9 mm when said conveyor belt is pressed to have a resilience pressure of 250 g/cm$^2$.

3. A sheet conveyor device of claim 2, wherein a diameter of said conveyor rollers is from 35 mm to 300 mm.

4. A sheet conveyor device of claim 1, wherein a circular protruded portion in a center area of an outer surface of said conveyor rollers support said conveyor belt.

5. A sheet conveyor device of claim 1, wherein said recording sheet material is a photosensitive sheet.

6. A clean booth that contains a conveyor belt for conveying a sheet material and a drive mechanism for driving said conveyor belt, said clean booth comprising:

a conveyor area in which said conveyor belt is located;

a drive area in which said drive mechanism is located;

a first housing which separates said conveyor area from an area external to said clean booth;

a separation wall which separates said conveyor area from said drive area; and a second housing which separates said drive area from the outside of area external to said clean booth, wherein a first air pressure in said drive area is lower than a second air pressure external to said clean booth, and a third air pressure in the conveyor area is higher than the first air pressure in the drive area.

7. A clean booth of claim 6, wherein said sheet material is a photosensitive sheet, and wherein said first housing and said separation plate have a light-shielding function.

8. A clean booth of claim 6, wherein a cutter device and an exhauster are located in said conveyor area, said cutter device cutting said sheet material into a plurality of cut sheets, and said exhauster absorbing dust emitted from said cutter device and said cut sheets.

9. A clean booth of claim 6, wherein an air pressure in said clean booth is controlled so that a third air pressure in said conveyor area is higher than the first air pressure in said drive area;

wherein an air pressure in said clean booth is controlled so that a first air pressure in said conveyor area is higher than that a second air pressure in said drive area.

10. A clean booth of claim 9, further comprising at least one fan filter unit for blowing clean and pressurized air into said conveyor area, wherein air in said drive area is discharged through a vent formed in said second housing.

11. A clean booth of claim 10, wherein said at least one fan filter unit is slidable between a first position to cover a top side of said conveyor area and blow clean air into said conveyor area, and a second position to expose the top side of said conveyor area.

12. A clean booth of claim 9, wherein the third air pressure in said conveyor area is higher than the second air pressure external to said clean booth.

13. A clean booth of claim 9, wherein a transmission shaft and a plurality of labyrinth seals are located in said conveyor area, said transmission shaft being rotatable to transmit drive power from said drive mechanism, and said labyrinth seals being fixed to said transmission shaft to protect said conveyor area from dust generated by rotational friction between said transmission shaft and said drive mechanism.

14. A clean booth of claim 6, wherein said conveyor belt comprises a belt base and an artificial suede layer on said belt base.

15. A clean booth of claim 14, wherein an elastic displacement of said conveyor belt is from 0.3 mm to 0.9 mm when said conveyor belt is pressed to have a resilience pressure of 250 g/cm$^2$.

* * * * *